United States Patent [19]

Murphy

[11] 3,977,521

[45] Aug. 31, 1976

[54] NOVEL BASEBALL EQUIPMENT STORAGE DEVICE

[76] Inventor: Helen M. Murphy, 43 Argyle St., Melrose, Mass. 02176

[22] Filed: June 3, 1974

[21] Appl. No.: 475,871

[52] U.S. Cl. ..... 206/315 R; 40/63 R; 40/312; 211/60 R; 220/20; 220/94 A; 224/45 L; 273/25; 312/234; 312/290

[51] Int. Cl.[2] ..... A47B 81/00; A63B 71/06; B65D 1/24; B65D 25/28; G09F 7/10

[58] Field of Search ..... 40/64 R, 65, 124.2, 40/156, 312, 313; 206/315, 526, 527; 211/13, 14, 60 R, 60 G, 60 T; 220/20, 21, 94 A; 224/45 R, 45 L, 45 Q, 45 J; 273/1 R, 25, 32 E, 72 R; 312/213, 234, 244, 290, 49

[56] References Cited

UNITED STATES PATENTS

| | | | |
|---|---|---|---|
| 2,325,483 | 7/1943 | Davis | 211/60 R |
| 2,720,189 | 10/1955 | Newman | 211/60 R X |
| 3,215,181 | 11/1965 | Reed | 224/45 R UX |
| 3,239,069 | 3/1966 | Hollins | 211/60 R |
| 3,394,817 | 7/1968 | Stembol et al. | 211/60 G |
| 3,650,407 | 3/1972 | Benham, Jr. | 211/14 |
| D164,503 | 9/1951 | Kerr | 211/60 G |

*Primary Examiner*—Steven E. Lipman
*Attorney, Agent, or Firm*—John P. Morley

[57] ABSTRACT

A transportable baseball equipment storage device and scoreboard including a substantially rectangular enclosure with a well in the top wall thereof for storing baseballs, a plurality of baseball bat compartments in the side wall of the enclosure, a plurality of pocket members in another sideall for displaying and interchangeably retaining medium bearing information relating to the progress of a baseball game, and a storage pocket in another sidewall for storing a scorebook.

1 Claim, 3 Drawing Figures

NOVEL BASEBALL EQUIPMENT STORAGE DEVICE

BACKGROUND OF THE INVENTION

1. The Field of the Invention

This invention relates to a dual-function, team equipment storage device useful for storing baseball equipment and for providing information relating to the progress of a baseball game. More precisely, the invention disclosed, herein, relates to an integral team equipment storage device and scoreboard which is particularly adaptable for use in amateur baseball games.

2. Description of the Prior Act

Amateur baseball games such as "Little League" baseball games are well known and are becoming increasingly popular throughout this country. Such games are usually played on playing fields which lack most of the sophisticated trappings usually associated with major or minor league playing fields. For example, many "Little League" playing fields lack dugouts, bat racks, scoreboards and usually include only such basic features as a wire screen, back stop and a small scale playing field.

The organization of such teams and games is of necessity, informal and more often than not, little attention is given to the care of the team equipment e.g., the team's baseball bats and practice baseballs. For example, the manager usually transports the team's equipment to and from the playing field and when such equipment is not in use, it is usually stored in the manager's vehicle. Normally, the bats and balls are stored or carried in a large duffle bag or a large trunk which loosely holds the bats and balls and the bag or trunk can be stepped on, sat on, kicked or bounced about. Under such conditions of transportation, the bats can strike against one another causing damage and accelerating wear and tear. Also, during the game, the bats are usually left on the ground after removal from the bag where they can be stepped on, tripped over or otherwise easily damaged or broken. Likewise, the practice balls used between innings by the infielders or outfielders are usually left on the ground when not in use where they can be stolen, lost or can cause injury should someone step or stumble on them.

The present invention provides a distinctive, easily transportable, integral team equipment storage device and scoreboard. Essentially, the device is designed to store the team's equipment in a fashion so that the equipment is neatly retained and ready for use and so that opportunities for damage to or loss of the equipment is minimized. The integration of a scoreboard with the storage device of the present invention is beneficial to both spectators and team members since such information will be conspicuous and readily available throughout the progress of the game, thereby maintaining and increasing interest in the game.

SUMMARY OF THE INVENTION

The integral baseball equipment storage device and scoreboard of the present invention comprises a substantially rectangular enclosure, shaped similar to a large suitcase but having at least one side thereof open. Essentially, the enclosure is defined by top and bottom members, a first pair of opposed, solid side members at least one of which is open to provide access between the first pair of opposed side members. A plurality of compartments are arranged between the first pair of side members so that each compartment can accommodate a plurality of baseball bats. A plurality of display means are integrated with at least one member of the first pair of side members. The display members are fixedly positioned on the side member and each display means is of the type which can interchangeably retain and display a medium, e.g., a card or the like bearing information relating to the progress of the game.

In the preferred embodiment of the present invention, a portion of the top member provides a well which can retain a plurality of baseballs. Also, handles or similar transport means are provided, preferably arranged in communication with the top member to provide for easy and convenient carrying and/or lifting of the integral equipment storage device and scoreboard. The present invention will be better understood and appreciated by reference to the following detailed description of a preferred embodiment thereof taken in connection with the attached figures.

DETAILED DESCRIPTION OF A PREFERRED EMBODIMENT

Figure 1:
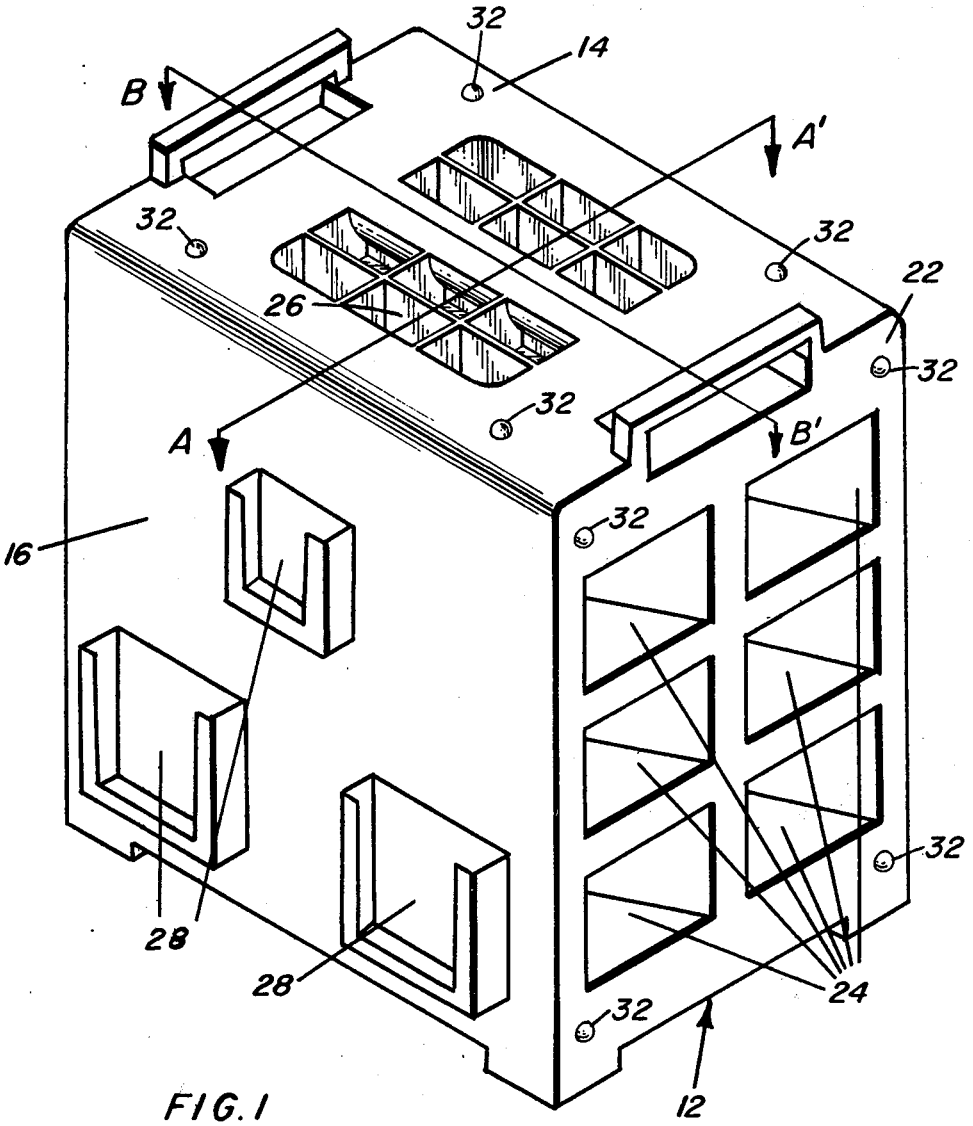
FIG. 1 is a perspective view of an arrangement of elements providing the integral baseball equipment storage device and scoreboard of the present invention.

Referring now to the Figures, the integral baseball equipment storage device and scoreboard is designated generally as 10, and comprises bottom member 12, top member 14, a first pair of opposed solid side members 16 and 18, and a second pair of opposed side members which are shown as solid side member 20, and open side member 22, which provides access to the space between first pair of side members 16 and 18. Side member 20, is preferably solid but both members of the second pair of opposed side members can be opened, if desired. A plurality of compartments, each designated as 24, are arranged between side members 16 and 18, so that each compartment 24, can accommodate a plurality of baseball bats (not shown). Preferably, each compartment 24, retains bats of the same size and/or weight, and each compartment 24, should be conspicuously labeled so that team members can conveniently select a bat of the desired size. Alternatively, the number of compartments 24, can be equivalent to the number of team members, so that each individual member can have a separate compartment for storage of their own bats.

Figure 3:
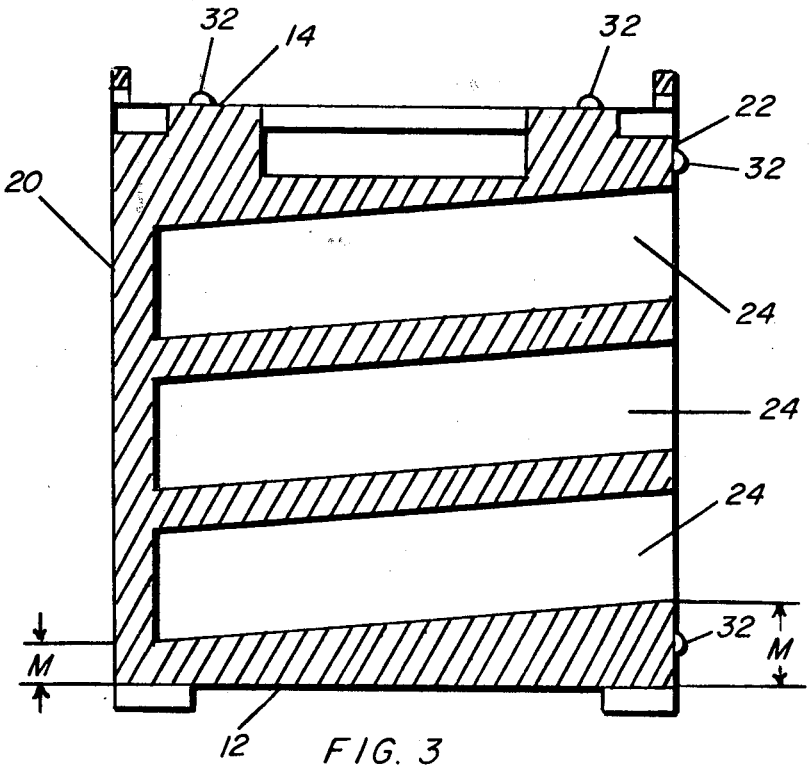
FIG. 3 is a sectional view of the arrangement of elements of FIG. 1 along line B—B1.

As shown in FIG. 3, the tops and bottoms of each compartment 24, are preferably pitched — at least slightly — so as to assure secure accommodations and retention of the bats in each compartment 24, especially during transportation of the integral baseball equipment storage device and scoreboard. Obviously, the overall length of each compartment should exceed the length of the bats to be stored therein.

In the preferred embodiment, illustrated in the Figures, a portion of top member 14, provides a well or baseball storage recepticle 26, to retain a plurality of baseballs. Well 26, should be preferably centered on top member 14, and should be large enough to accommodate about a dozen baseballs. In the embodiment shown in the figures, well 26, comprises twelve individual compartments, each of which can accommodate one baseball that is easily lifted from the individual compartment. Also, handles or like transport, means 28, are preferably associated with top member 14, or, if desired, transport means 28, can be associated with the upper regions side members 18 and 20, or side members 16 and 18.

Figure 2:
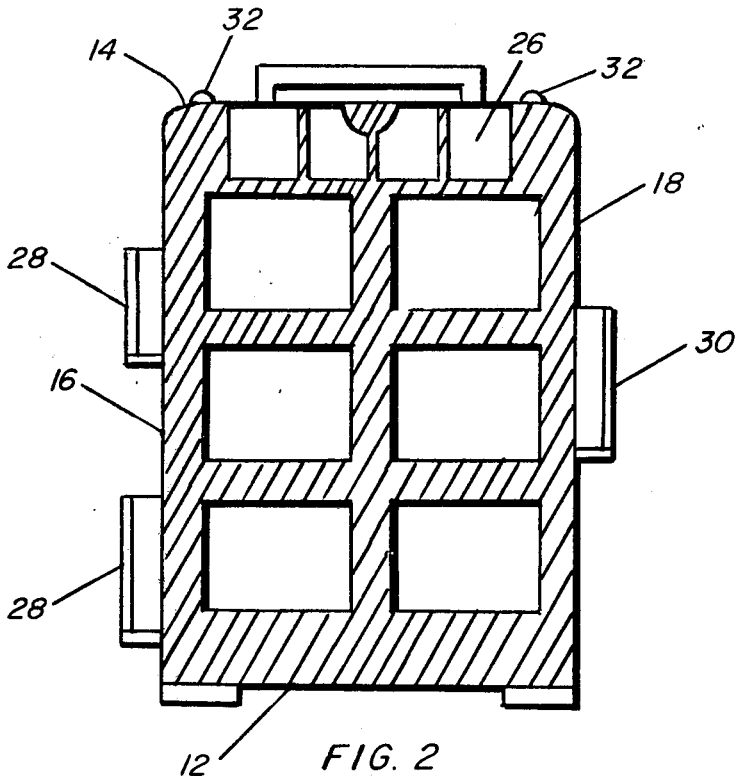
FIG. 2 is a sectional view of the arrangement of elements of FIG. 1 along line A—A1.

Display means 28, are integrated with the external surface of at least one of the members of the first pair of opposed solid side members. Essentially, display means 28, can interchangeably retain cards containing information relating to the score and inning, but it should be understood that additional display means can be provided to display other information relating to the game, such as the name of the players at bat, or the team's lineup, etc. FIG. 1, illustrates a preferred arrangement of display means 28, where each is shown as a three sided bracket which can securely retain cards bearing information relating to the inning and score but provides for easy removal of the cards, therefrom as the inning and/or score changes. The arrangement of display means 28, on side 16, should preferably be symmetrical and each display means 28, should be large enough to accommodate cards that can conspiciously display information relating to the progress of the game. In the preferred embodiment, a pocket 30, (FIG. 2), is provided integrated with side 18. Pocket 30, provides additional storage means for storing a scorebook, the cards used in display means 28, and other incidental materials, sometimes used during the game for example, a first aid kit or the like. Pocket 30, can be fabricated of a flexible plastic material or canvas preferably having an elastic capability associated therewith so that it is stretchable at least about the top portion of Pocket 30.

The integral equipment storage device and scoreboard of the Figures is fabricated of a durable, heavy duty, solid plastometric material such as fiber glass. Preferably, all the top, bottom and side members are molded together as a unitary piece and the particular compartment arrangement and display devices are assembled therewith in known manners. Alternatively, the structural members or components can be molded or otherwise fabricated separately and assembled in manners known to the art. Representative overall dimensions of the embodiment shown in the Figures are height 32 inches, length 30 inches and width 22 inches, while each of the six compartments 24, are 6 inches × 8 inches. Cover retaining means 32, are provided on top 14, and open side 18, to secure covers (not shown) which are placed completely over well 26, and compartments 24, when device 10, is not in use or is being transported from place to place. The covers can be fabricated of solid plastic materials or of flexible plastics or canvas or the like and are provided with fastening means which can be snapped on or otherwise secured to cover retaining means 32.

As can be appreciated from the foregoing description, the integral baseball equipment storage device and scoreboard of the present invention provides distinctive features designed to meet outstanding problems in "Little League" baseball. When the device is not in use at a game, it serves to store equipment in a neat, compact manner minimizing occasions for the bats, for example, to strike against one another or be stepped on or sat upon as is the case when such equipment is stored in a duffle bag. During a game, the bats and balls are stored neatly and safely, and yet are easily accessable and ready for use by the team members. Also, during the game, the device functions as a scoreboard providing information not readily available at most "Little League" playing fields to participants as well as spectators, thereby serving to increase and maintain interest in the game.

Many modifications of incidental details of the foregoing description offered for the purposes of illustrating the invention may be made without departing from the spirit and scope of the invention defined in the appended claims.

I claim:

1. An integral baseball equipment storage device and scoreboard which comprises a substantially rectangular enclosure defined by top and bottom members, said top member having a well which comprises a plurality of individual compartments each of which can retain a baseball; a first pair of solid opposed side members, a second pair of opposed side members, at least one of which is open; a plurality of compartments accessable through said open side member and extending between said first pair of side members so that each compartment can retain a plurality of baseball bats; display means positioned on at least one member of said first pair of side members, said display means being capable of displaying and interchangably retaining a medium bearing information relating to the progress of a baseball game; storage means positioned on the second member of said first pair of opposed side members for storing a scorebook or other small equipment; and means integrated with said storage device for transporting said device from place to place.

* * * * *